US009945646B2

(12) United States Patent
Barnett

(10) Patent No.: US 9,945,646 B2
(45) Date of Patent: Apr. 17, 2018

(54) CROSSBOW DISCHARGE BOLT AND METHOD

(71) Applicant: Barnett Outdoors, LLC, Tarpon Springs, FL (US)

(72) Inventor: David A. Barnett, Tarpon Springs, FL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 7 days.

(21) Appl. No.: 14/589,645

(22) Filed: Jan. 5, 2015

(65) Prior Publication Data

US 2016/0195373 A1 Jul. 7, 2016

(51) Int. Cl.

| | |
|---|---|
| ***F42B 6/08*** | (2006.01) |
| ***F42B 6/02*** | (2006.01) |
| ***F41B 5/12*** | (2006.01) |
| ***F42B 6/04*** | (2006.01) |
| ***F41B 5/14*** | (2006.01) |

(52) U.S. Cl.
CPC ..... *F42B 6/02* (2013.01); *F41B 5/12* (2013.01); *F41B 5/148* (2013.01); *F42B 6/04* (2013.01); *F42B 6/08* (2013.01)

(58) Field of Classification Search
CPC ..... F42B 6/04; F42B 6/06; F42B 6/08
See application file for complete search history.

(56) References Cited

U.S. PATENT DOCUMENTS

| | | | | |
|---|---|---|---|---|
| 1,423,551 | A * | 7/1922 | Adriance | F42B 6/003 473/582 |
| 1,789,575 | A * | 1/1931 | Allen | F42B 6/04 473/585 |
| 4,615,552 | A * | 10/1986 | Bengtson | F42B 6/06 244/3.24 |
| 5,423,553 | A * | 6/1995 | Krieg | F42B 6/06 473/586 |
| 5,902,199 | A * | 5/1999 | Adams, Jr. | F42B 6/04 473/578 |
| 6,554,725 | B1 * | 4/2003 | Schaar | F42B 6/04 473/578 |
| 6,932,728 | B2 * | 8/2005 | Palomaki | F42B 6/08 473/578 |
| 7,935,012 | B2 * | 5/2011 | Lee | F42B 6/08 473/578 |
| 8,123,636 | B1 * | 2/2012 | Temprine | F42B 6/06 473/578 |
| 8,323,133 | B1 * | 12/2012 | Middendorf | F42B 6/06 473/586 |
| 8,376,882 | B2 | 2/2013 | Shaffer et al. | |
| 8,500,579 | B1 | 8/2013 | Long et al. | |
| 2010/0031945 | A1 | 2/2010 | Shaffer et al. | |
| 2011/0218063 | A1 | 9/2011 | Hunt | |
| 2014/0031153 | A1 | 1/2014 | Boretto | |

OTHER PUBLICATIONS

International Search Report and Written Opinion of the International Searching Authority in Applicant's counterpart International Application No. PCT/US2016/12143.

* cited by examiner

*Primary Examiner* — John Ricci
(74) *Attorney, Agent, or Firm* — Jones Walker LLP

(57) ABSTRACT

A crossbow discharge bolt for preventing damage to a crossbow associated with dry firing. The crossbow discharge bolt has a length of 10 inches or less and a weight of at least 330 grains. The length may be in the range of 6 to 10 inches. The weight may be in the range of 330 to 600 grains.

21 Claims, 7 Drawing Sheets

CROSSBOW DISCHARGE BOLT AND METHOD

DETAILED DESCRIPTION OF THE PREFERRED EMBODIMENTS

Firing a crossbow without an arrow (i.e., dry firing) can damage the crossbow. However, it is sometimes desirable to discharge a crossbow without an arrow. For example, while a user may cock a crossbow at the beginning of a hunt, he or she may not fire the crossbow before ending the hunt. Accordingly, the user will need to uncock the crossbow, but he or she may not wish to fire an arrow. Prior art methods of uncocking crossbows include firing a dummy arrow, which is usually the same size as a conventional crossbow arrow. Conventional crossbow arrows are between 18 and 22 inches in length and weigh between 400 and 425 grains.

Figure 1:
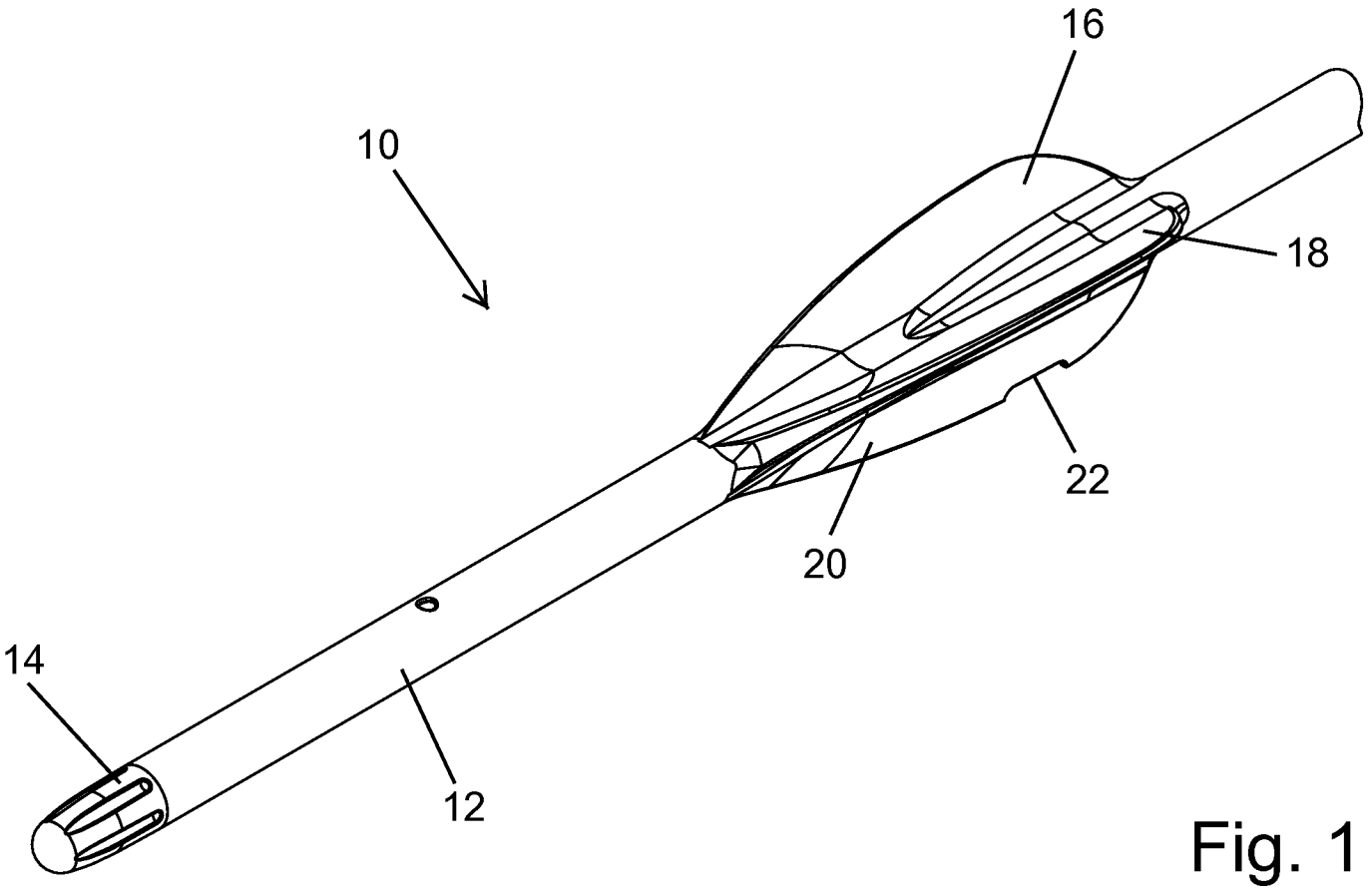
FIG. 1 is a perspective view of a crossbow discharge bolt.
Figure 2:
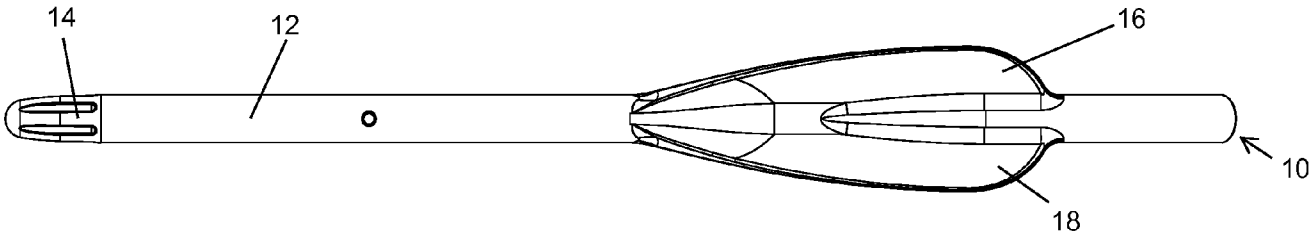
FIG. 2 is a top view of the crossbow discharge bolt.
Figure 3:
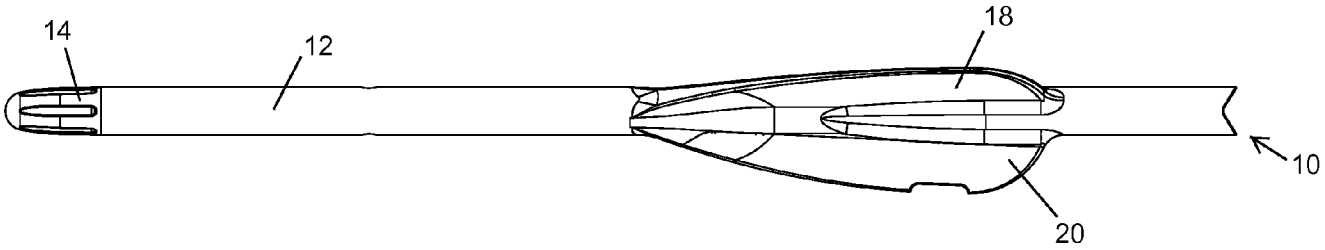
FIG. 3 is a side view of the crossbow discharge bolt.
Figure 4:
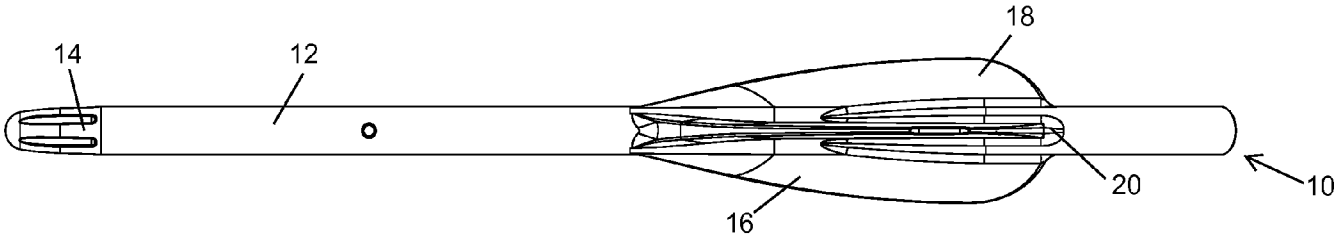
FIG. 4 is a bottom view of the crossbow discharge bolt.
Figure 5:
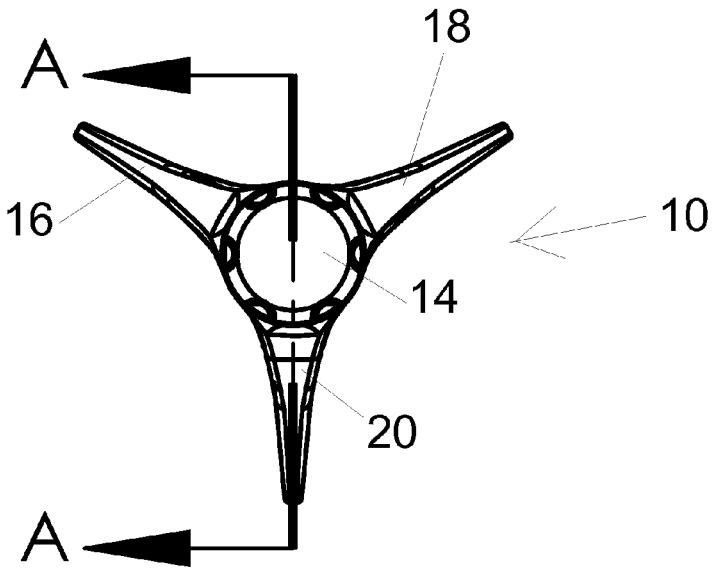
FIG. 5 is a front view of the crossbow discharge bolt.
Figure 6:
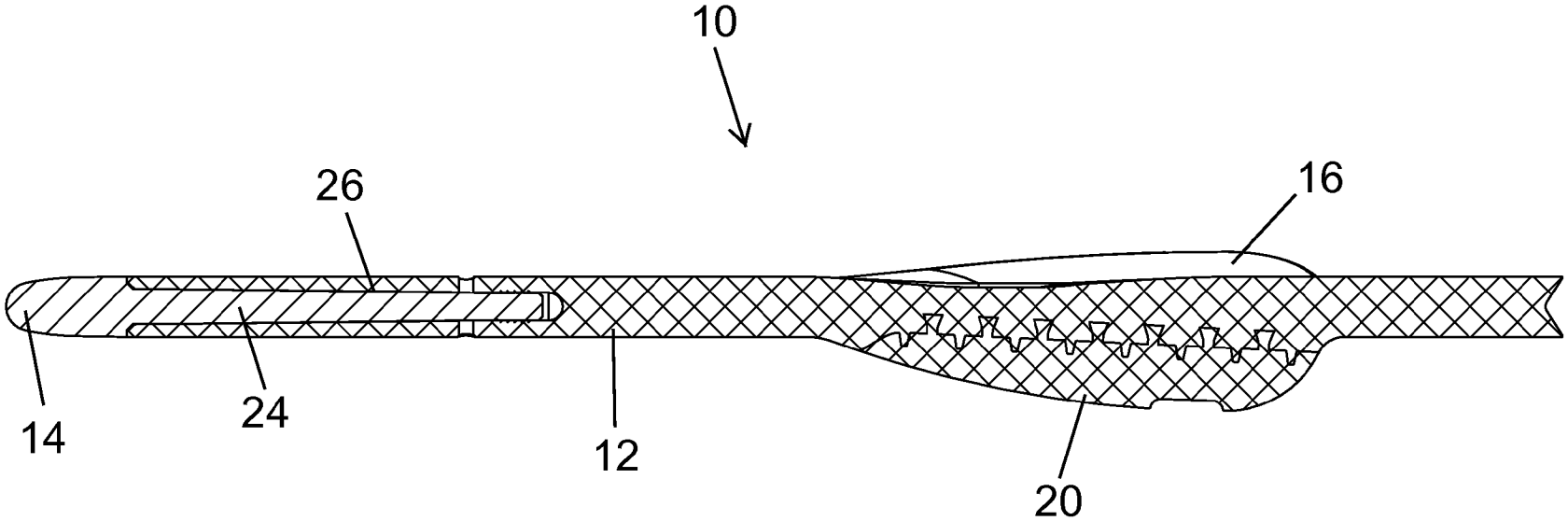
FIG. 6 is a cross-sectional view of the crossbow discharge bolt taken along line A-A of FIG. 5.

FIGS. 1-4 illustrate crossbow discharge bolt 10 including shaft 12, tip 14, and fletches 16, 18, and 20. Shaft 12 may be formed of a polymer or a metal. Tip 14 may be formed of steel or another metal. Fletches 16, 18, and 20 may be formed of a polymer. Fletch 20 may include recess 22 to distinguish fletch 20 from the other fletches 16 and 18. Alternatively, fletch 20 may be a different color than fletches 16 and 18. In another alternate embodiment, fletch 20 may glow in the dark. Fletch 20 may be designed to be positioned in a flight path of a crossbow track in order to appropriately orient crossbow discharge bolt 10 on a crossbow. Accordingly, crossbow discharge bolt 10 may be designed to be oriented with fletch 20 facing downward as shown in FIG. 5. As shown in FIG. 6, extension 24 of tip 14 may extend into central bore 26 of shaft 12.

Figure 7:
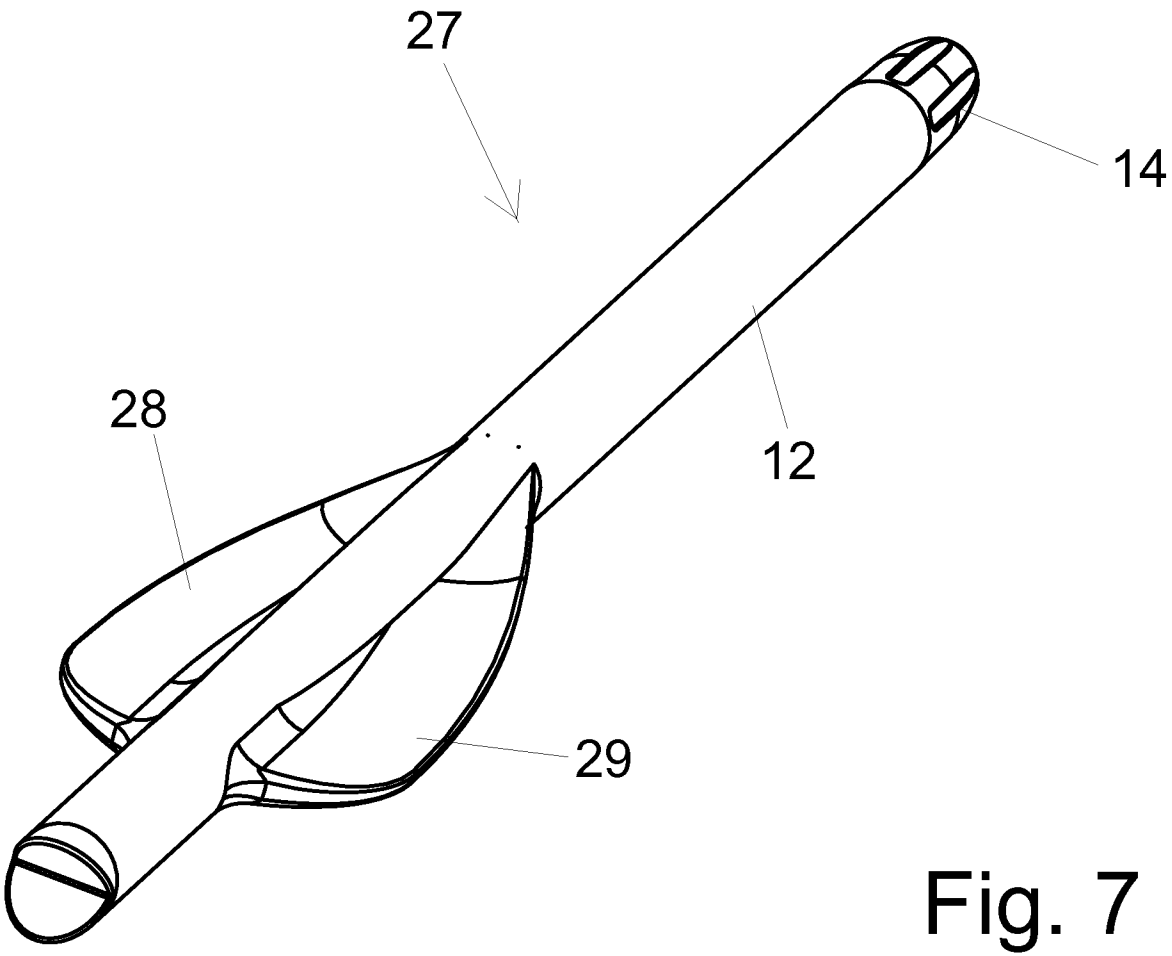
FIG. 7 is a perspective view of an alternate embodiment of the crossbow discharge bolt.
Figure 8:
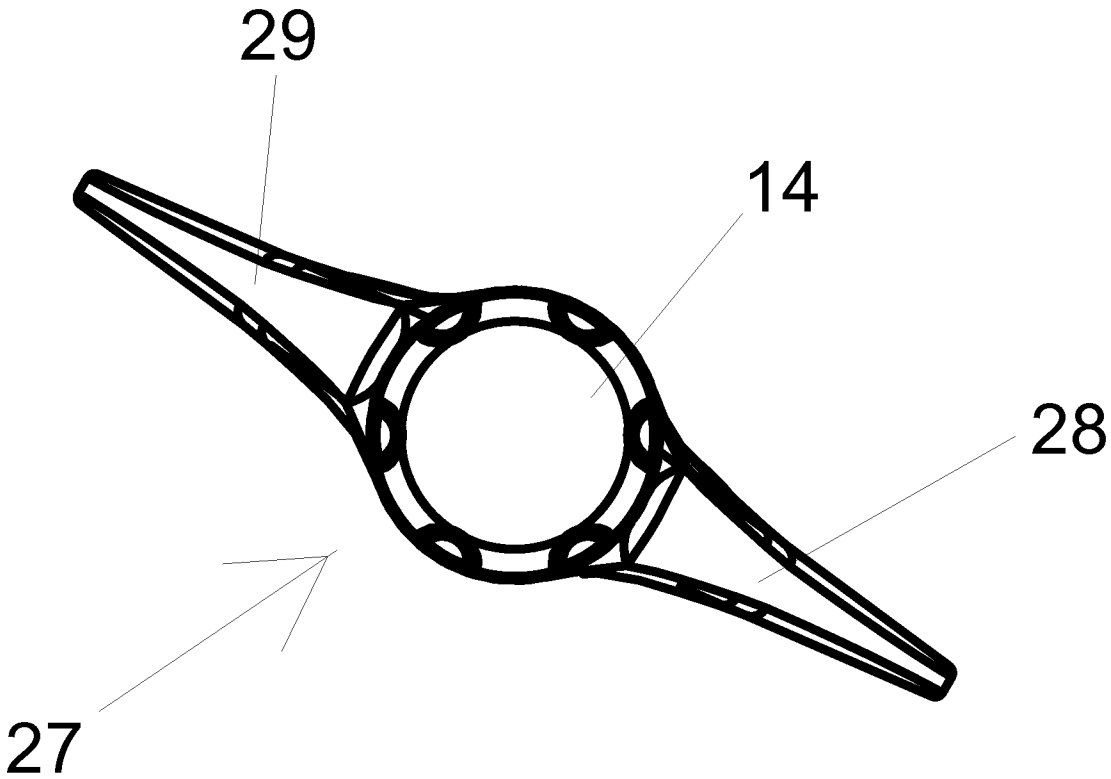
FIG. 8 is a front view of the crossbow discharge bolt of FIG. 7.

In an alternate embodiment, crossbow discharge bolt 10 may include fewer than three fletches. For example, FIGS. 7 and 8 illustrate crossbow discharge bolt 27 including fletches 28 and 29.

Figure 9:
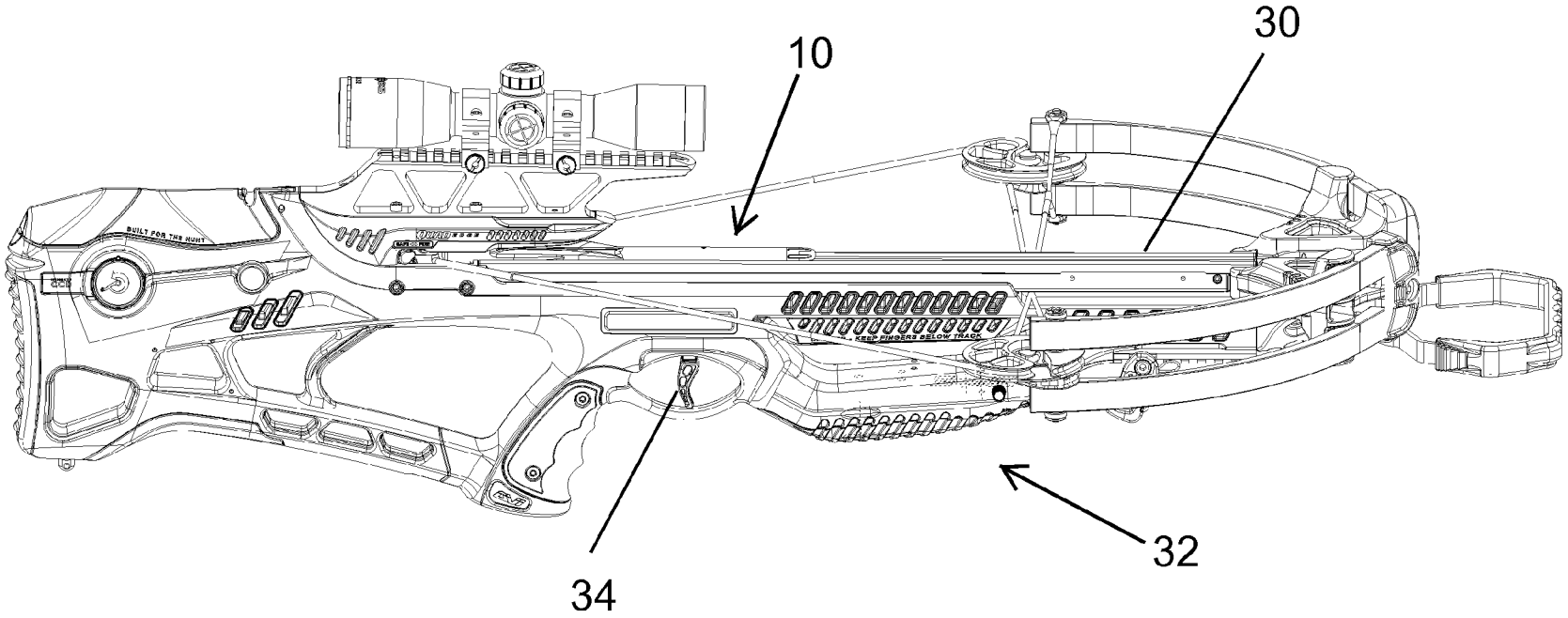
FIG. 9 is a side view of the crossbow discharge bolt positioned on a crossbow.

With reference to FIG. 9, crossbow discharge bolt 10 may be placed on track 30 of crossbow 32. A user may fire crossbow 32 with crossbow discharge bolt 10 by activating trigger 34 of crossbow 32. Crossbow discharge bolt 10 may be used to protect crossbow 32 from damage associated with dry firing when use of a conventional arrow is undesirable.

Crossbow discharge bolt 10 may have a length of 10 inches or less. Alternatively, crossbow discharge bolt 10 may have a length of 9 inches or less. In another embodiment, crossbow discharge bolt 10 may have a length of 8 inches or less. In a further embodiment, crossbow discharge bolt 10 may have a length of 7 inches or less. In one embodiment, crossbow discharge bolt 10 has a length in the range of 6-10 inches. Alternatively, crossbow discharge bolt 10 may have a length in the range of 7-9 inches. In another embodiment, crossbow discharge bolt 10 may have a length in the range of 7.5-8.5 inches.

Crossbow discharge bolt 10 may have a weight of at least 330 grains. Alternatively, crossbow discharge bolt 10 may have a weight of at least 400 grains. In another embodiment, crossbow discharge bolt 10 may have a weight of at least 450 grains. In a further embodiment, crossbow discharge bolt 10 may have a weight of at least 500 grains. In yet another embodiment, crossbow discharge bolt 10 may have a weight of at least 550 grains. In one embodiment, crossbow discharge bolt 10 may have a weight in the range of 330-600 grains. Alternatively, crossbow discharge bolt 10 may have a weight in the range of 400-550 grains. In another embodiment, crossbow discharge bolt 10 may have a weight in the range of 450-500 grains. The weight of crossbow discharge bolt 10 may be determined by the material of tip 14.

Accordingly, crossbow discharge bolt 10 may have a smaller length than conventional crossbow arrows, but may have a weight that is approximately the same as or larger than the conventional crossbow arrows. The smaller length provides added convenience to a user in transporting crossbow discharge bolt 10, but the high weight protects the crossbow by allowing crossbow discharge bolt 10 to absorb the energy of the crossbow during firing.

While preferred embodiments of the present invention have been described, it is to be understood that the embodiments are illustrative only and that the scope of the invention is to be defined solely by the appended claims when accorded a full range of equivalents, many variations and modifications naturally occurring to those skilled in the art from a review hereof.

The invention claimed is:

1. A crossbow discharge bolt comprising:

a shaft having a front end, a middle portion, a central bore, and an outer diameter;

a tip attached to the front end of the shaft, the tip having an outer diameter, the tip including an external portion positioned exterior to the front end of the shaft and an extension portion extending longitudinally from the external portion and positioned within the central bore of the shaft;

one or more fletches attached to the middle portion of the shaft;

wherein the crossbow discharge bolt has a length of 10 inches or less and a weight of at least 330 grains;

wherein the shaft has a solid interior and wherein the central bore of the shaft is formed by placement of the solid interior of the shaft around the extension portion of the tip;

wherein the external portion of the tip terminates at a blunt tip end; and wherein the outer diameter of the tip is not greater than the outer diameter of the shaft.

2. The crossbow discharge bolt of claim 1, wherein the crossbow discharge bolt has a length of 9 inches or less.

3. The crossbow discharge bolt of claim 1, wherein the crossbow discharge bolt has a length of 8 inches or less.

4. The crossbow discharge bolt of claim 1, wherein the crossbow discharge bolt has a length of 7 inches or less.

5. The crossbow discharge bolt of claim 1, wherein the crossbow discharge bolt has a length in the range of 6 to 10 inches.

6. The crossbow discharge bolt of claim 1, wherein the crossbow discharge bolt has a length in the range of 7 to 9 inches.

7. The crossbow discharge bolt of claim 1, wherein the crossbow discharge bolt has a length in the range of 7.5 to 8.5 inches.

8. The crossbow discharge bolt of claim 1, wherein the crossbow discharge bolt has a weight of at least 400 grains.

9. The crossbow discharge bolt of claim 1, wherein the crossbow discharge bolt has a weight of at least 450 grains.

10. The crossbow discharge bolt of claim 1, wherein the crossbow discharge bolt has a weight of at least 500 grains.

11. The crossbow discharge bolt of claim 1, wherein the crossbow discharge bolt has a weight of at least 550 grains.

12. The crossbow discharge bolt of claim 1, wherein the crossbow discharge bolt has a weight in the range of 330 grains to 600 grains.

13. The crossbow discharge bolt of claim 1, wherein the crossbow discharge bolt has a weight in the range of 400 grains to 550 grains.

14. The crossbow discharge bolt of claim 1, wherein the crossbow discharge bolt has a weight in the range of 450 grains to 500 grains.

15. The crossbow discharge bolt of claim 1, wherein one of the fletches includes a recess.

16. The crossbow discharge bolt of claim 1, wherein one of the fletches is formed of a glow in the dark material.

17. A method of uncocking a crossbow, comprising the steps of:

a) providing a crossbow discharge bolt comprising: a shaft having a front end, a middle portion, and a central bore, and an outer diameter; a tip attached to the front end of the shaft, the tip having an outer diameter, the tip including an external portion positioned exterior to the front end of the shaft and an extension portion extending longitudinally from the external portion and positioned within the central bore of the shaft; one or more fletches attached to the middle portion of the shaft; wherein the crossbow discharge bolt has a length of 10 inches or less and a weight of at least 330 grains; wherein the shaft has a solid interior and wherein the central bore of the shaft is formed by placement of the solid interior of the shaft around the extension portion of the tip; wherein the external portion of the tip terminates at a blunt tip end; and wherein the outer diameter of the tip is not greater than the outer diameter of the shaft;

b) positioning the crossbow discharge bolt on a track of the crossbow with the crossbow in a cocked position; and c) firing the crossbow with the crossbow discharge bolt by activating a trigger of the crossbow.

18. The method of claim 17, wherein the crossbow discharge bolt has a length of 9 inches or less.

19. The method of claim 17, wherein the crossbow discharge bolt has a length of 7 inches or less.

20. The method of claim 17, wherein the crossbow discharge bolt has a weight of at least 400 grains.

21. The method of claim 17, wherein the crossbow discharge bolt has a weight of at least 550 grains.

* * * * *